United States Patent [19]

Goschke

[11] Patent Number: 4,854,415

[45] Date of Patent: Aug. 8, 1989

[54] HEARING AID WHOSE COMPONENTS ARE MOUNTED IN A HEARING AID HOUSING

[75] Inventor: Bernd Goschke, Hannberg, Fed. Rep. of Germany

[73] Assignee: Siemens Aktiengesellschaft, Berlin and Munich, Fed. Rep. of Germany

[21] Appl. No.: 163,554

[22] Filed: Mar. 3, 1988

[30] Foreign Application Priority Data

Mar. 23, 1987 [DE] Fed. Rep. of Germany ... 8704315[U]

[51] Int. Cl.[4] ..... H04R 25/02

[52] U.S. Cl. ..... 181/130; 181/135; 381/68.6; 381/69; 381/169; 381/187; 381/205

[58] Field of Search ..... 181/130, 135; 381/68.6, 381/69, 69.2, 169, 187, 188, 205

[56] References Cited

U.S. PATENT DOCUMENTS

| | | | |
|---|---|---|---|
| 3,257,516 | 6/1966 | Knowles | 381/158 |
| 3,529,102 | 9/1970 | Rosenstand | 381/68.6 |
| 3,783,201 | 1/1974 | Weiss et al. | 381/69 X |
| 3,812,300 | 5/1974 | Brander et al. | 381/69 |
| 4,440,982 | 4/1984 | Kaanders et al. | 381/69 |
| 4,476,353 | 10/1984 | Haertl | 381/69 X |
| 4,729,451 | 3/1988 | Brander et al. | 181/170 |

FOREIGN PATENT DOCUMENTS

| | | |
|---|---|---|
| AS 1160504 | 1/1964 | Fed. Rep. of Germany . |
| 539375 | 8/1973 | Switzerland . |

*Primary Examiner*—B. R. Fuller

*Attorney, Agent, or Firm*—Hill, Van Santen, Steadman & Simpson

[57] ABSTRACT

The component parts of a hearing aid are releasably inserted into the inside of mounts to be secured in the interior of the hearing aid housing. The mounts are provided at their inside with an elastic material that is preferably fashioned as a plurality of nubs and that exerts an elastic spring power onto the inserted component parts. The mounts can hold component parts of different sizes and are also sound-absorbing.

7 Claims, 1 Drawing Sheet

HEARING AID WHOSE COMPONENTS ARE MOUNTED IN A HEARING AID HOUSING

BACKGROUND OF THE INVENTION

1. Field of the Invention

The present invention is directed to a hearing aid whose component parts ae mounted in a hearing aid housing.

2. Description of the Prior Art

In known hearing aids for example, Swiss Pat. No. 539 375 or German reference B-11 60 504), components such as, for example, ear phone or microphone as well are usually seated in elastic pockets in the housing. Such mounting holding solutions as well as, for example, the mounting mechanism of U.S. Pat. No. 3,257,516 are extremely impractical. In particular, the replacement of component parts in these known solutions requires a multitude of manipulations. Gluing the mounting cushions onto the component parts according to U.S. Pat. No. 3,529,102 is just as involved and time-consuming.

SUMMARY OF THE INVENTION

An object of the present invention is to construct a mount for component parts of a hearing aid that may also differ in size that enables an effortless replacement of component parts and that nonetheless retains the inserted component parts.

This object is inventively achieved by releasably holding the component parts in the inside of mounts between pillows of elastic material projecting into the interior of the mounts that are rigidly connected to the mounts. In an embodiment of the invention wherein the elastic material is also sound-absorbing, acoustic feedback effects are avoided even better than hitherto.

According to the invention, various component parts, particularly microphone and ear phone, are inserted into box-shaped mounts. The mounts are inwardly cushioned with pillows that are preferably fashioned as nubs of sound-absorbing material. When the component parts are plugged in, the pillows are elastically displaced and retain the component parts in the mount on the basis of elastic clamping power. With, for example, a tweezers, however, the component parts can be removed from the mount. Given the employment of sound-absorbing material, sound-sensitive component parts can be protected against injurious unwanted signals. The disadvantages of the prior art thus no longer occur.

BRIEF DESCRIPTION OF THE DRAWINGS

Further advantages and details of the invention derive from the following description of an exemplary embodiment.

Shown are.

DESCRIPTION OF THE PREFERRED EMBODIMENTS

Figure 1:
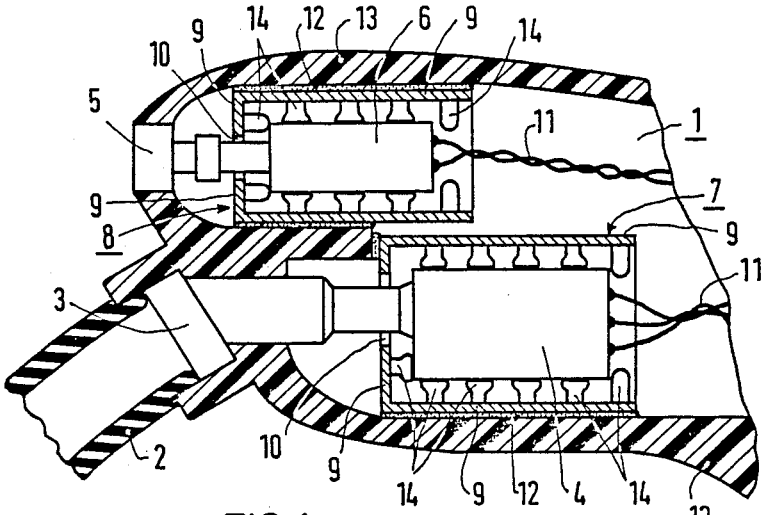
FIG. 1 are inventively mounted component parts (for example, microphone and ear phone) in a hearing aid housing, shown in longitudinal section.

FIG. 1 shows a part of a hearing aid 1 that is to be worn behind the ear. A carrying hook 2 that encompasses a sound exit line 3 is situated at the end of this part. The sound exit line 3 leads to an ear phone 4. A sound entry line 5 is situated above the line 3 and conducts the sound entering from the outside into a microphone 6.

Ear phone 4 and microphone 6 are situated in inventively fashioned mounts 7 and 8. The box-shaped mounts 7 and 8 each comprise five preferably rigid walls 9, whereby respectively one wall has an opening 10 for the sound lines 3 and 5. No wall is situated at the opposite side from opening 10. Ear phone 4 and microphone 6 can be inserted into the mounts 7 and 8 proceeding from this side and can be removed again as needed. The connecting cables 11 of the component parts 4 and 6 are also conducted out of the mounts 7 and 8 proceeding from this open side.

The mounts 7 and 8 are glued to the housing shell 13 of the hearing aid 1 with, for example, adhesive 12. However, they can also be placed, for example, in prepared housing compartments within the housing shell. Elastic, sound-damping nubs 14 (of, for example, butyl) are located at the insides of the walls 9, these nubs 14 holding the inserted component parts 6 and 4 in the mounts 7 on the basis of elastic spring power and preventing acoustic feedback. Since the nubs 14 are elastic and, thus, deformable, component parts of different sizes can be inserted into the same mount (in this regard, see FIG. 2).

Although the mounts of the invention are shown in FIG. 1 in a behind-the-ear hearing aid, such mounts can, however, also be employed in in-the-ear hearing aids.

Figure 2:
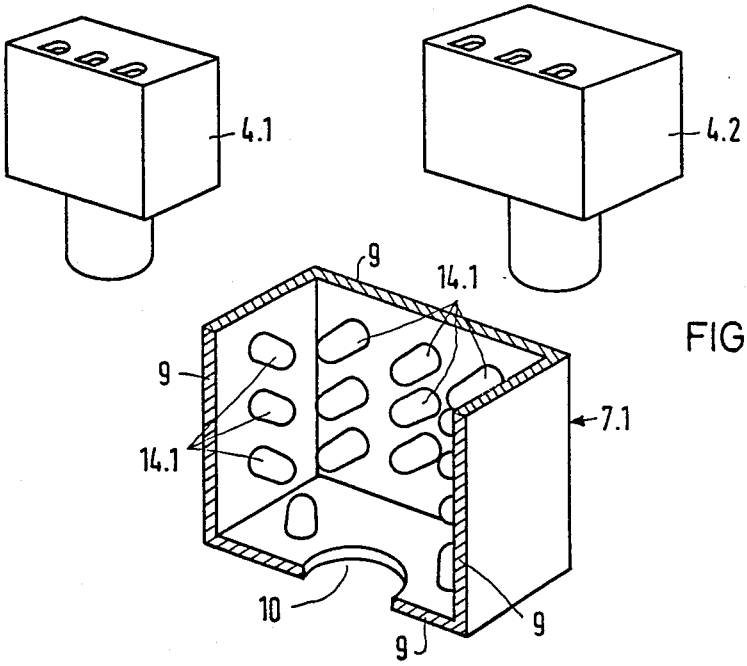
FIG. 2 is an inventively fashioned mount in a perspective section with two ear phones of different size in an exploded view.

FIG. 2 shows a mount 7.1 of a type that was already described in conjunction with FIG. 1. It is shown here without hearing aid housing and in a perspective section. Two ear phones 4.1 and 4.2 of different sizes are shown adjacent to the mount. Either the small ear phone 4.1 or the large ear phone 4.2, however, can be inserted into the mount 7.1 since the nubs 14.1 of the mount 7.1 are adequately deformable in order to adapt to the volumes of both ear phones.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A hearing aid and said inwardly projecting sound absorbing material serving to accomodate various sized component parts in a hearing aid housing, comprising at least one part of the component parts being releasably held in an interior portion of the mounts, said mounts being fashioned as box-shaped, each having five rigid interconnecting walls and a remaining, uncovered side serving as an opening for an insertion of the component parts, an inside of each wall of said mounts having an inwardly projecting pillow of elastic, sound absorbing material that is rigidly connected to the mounts constituted by component parts held by mounts.

2. A hearing aid according to claim 1, wherein the pillows comprise a plurality of nubs.

3. A hearing aid according to claim 1, wherein the pillows are formed of butyl material.

4. A hearing aid according to claim 1, wherein each wall is provided with a plurality of elastic nubs comprising said pillows.

5. A hearing aid according to claim 1, wherein the component parts have contact terminals and are positioned such in the box-shaped mounts that said contact terminals are directed toward the uncovered side and at least one wall encompasses a sound opening.

6. A hearing aid according to claim 1, wherein at least one mount contains an ear phone.

7. A hearing aid according to claim 1, wherein at least one mount contains a microphone.

* * * * *